United States Patent [19]

Anderson et al.

[11] 4,361,447

[45] Nov. 30, 1982

[54] EXTRUSION-FORMED URANIUM-2.4 WT. % ARTICLE WITH DECREASED LINEAR THERMAL EXPANSION AND METHOD FOR MAKING THE SAME

[75] Inventors: Robert C. Anderson, Crossville; Jack M. Jones; Thomas G. Kollie, both of Oak Ridge, all of Tenn.

[73] Assignee: The United States of America as represented by the United States Department of Energy, Washington, D.C.

[21] Appl. No.: 381,277

[22] Filed: May 24, 1982

[51] Int. Cl.[3] ..... C22F 1/18; C22C 43/00

[52] U.S. Cl. ..... 148/11.5 F; 75/122.7; 148/11.5 R; 148/132; 148/401

[58] Field of Search ..... 148/32, 11.5 R, 132, 148/11.5R; 75/122.7

[56] References Cited

U.S. PATENT DOCUMENTS

| | | | |
|---|---|---|---|
| 2,914,433 | 7/1982 | McGeary et al. | 148/11.5 R |
| 3,072,475 | 7/1982 | Baker et al. | 75/122.7 |
| 3,098,807 | 7/1982 | Lewis | 148/132 |

OTHER PUBLICATIONS

Jetter et al., "Preferred Orientation in Extruded Uranium Rod", Transactions of AIME, Journal of Metals, Feb. 1957, p. 291.

*Primary Examiner*—L. Dewayne Rutledge
*Assistant Examiner*—Debbie Yee
*Attorney, Agent, or Firm*—Earl L. Larcher; Stephen D. Hamel; Richard G. Besha

[57] ABSTRACT

The present invention is directed to the fabrication of an article of uranium-2.4 wt. % niobium alloy in which the linear thermal expansion in the direction transverse to the extrusion direction is less than about 0.98% between 22° C. and 600° C. which corresponds to a value greater than the 1.04% provided by previous extrusion operations over the same temperature range. The article with the improved thermal expansion possesses a yield strength at 0.2% offset of at least 400 MPa, an ultimate tensile strength of 1050 MPa, a compressive yield strength of at least 0.2% offset of at least 675 MPa, and an elongation of at least 25% over 25.4 mm/sec. To provide this article with the improved thermal expansion, the uranium alloy billet is heated to 630° C. and extruded in the alpha phase through a die with a reduction ratio of at least 8.4:1 at a ram speed no greater than 6.8 mm/sec. These critical extrusion parameters provide the article with the desired decrease in the linear thermal expansion while maintaining the selected mechanical properties without encountering crystal disruption in the article.

6 Claims, No Drawings

EXTRUSION-FORMED URANIUM-2.4 WT. % ARTICLE WITH DECREASED LINEAR THERMAL EXPANSION AND METHOD FOR MAKING THE SAME

This invention was made as a result of a contract with the United States Department of Energy.

BACKGROUND OF THE INVENTION

The present invention is directed generally to extrusion-formed articles of uranium-2.4 wt.% niobium alloys with controlled linear thermal expansion and, more particularly, to the preparation of such articles in which the linear thermal expansion in the direction transverse to the longitudinal axis of the extrusion is less than 0.98% over a temperature range of 22° C. to 600° C.

The formation of uranium-2.4 wt.% niobium alloy articles by the alphaphase extrusion of the alloy has been used to provide high strength and yet ductile articles of the alloy which have a yield strength at 0.2% offset of at least 400 MPa, an ultimate tensile strength of at least 1,050 Mpa, a compressive yield strength at 0.2% offset of 675 MPa and an elongation greater than 25%. These extruded uranium alloy articles have a polycrystalline structure which provides a linear thermal expansion (LTE) in the direction transverse to the longitudinal axis of the extrusion of greater than 1.04% in a temperature range between 22° C. and 600° C.

While the strength and ductility of the extruded alloy provide desirable properties, the LTE in the direction transverse to the direction of extrusion may be excessive in applications when the article is associated with another material having a linear expansion of less than the U-2.4 Nb alloy. For example, in applications where an article of the uranium alloy is clad or provided with a protective coating and subjected to temperature variations within the aforementioned range, the LTE in the transverse direction may cause stresses or the separation of the coating or cladding from the uranium article due to the differences in the expansion of alloy and the material used for the cladding or coating. Also, in applications where the alloy article is brazed to a support member, the brazing temperatures necessary for effecting the joint may heat the alloy article sufficiently to cause a strain at the brazed joint upon cooling due to the LTE of the alloy so as to fail or deleteriously weaken the brazed joint.

As will be described below, the aim of the present invention is to prepare articles of the uranium-2.4 wt.% niobium alloy by extrusion that possess the aforementioned strength and ductility properties of the alloy and which also posess a crystallographic texture that provides an LTE in the transverse direction of less than 0.98% between the the temperatures of 22° C. to 600° C. The thermal expansion of uranium-2.4 wt.% niobium alloy is dependent upon both the phase changes during the measurement of thermal expansion and the crystallography of the alpha phase in the direction of measurement. The thermal expansion behavior is dependent upon the crystallography due to the anisotropic nature of the thermal expansion of uranium. The mean axial thermal expansion coefficients of alpha uranium are $+35.6$ and $+31.6\times10^{-6}$/°C. in the a and c axes, respectively, and $-8.4\times10^{-6}$/°C. for the b axis between 27° C. and 640° C. As described in the article, "Preferred Orientation in Extruded Uranium Rod", reported in Transactions of the AIME, Journal of Metals, February 1957, p. 291, the crystallographic texture of alpha uranium is changed by the alpha-phase extrusion. During extrusion operations the b crystallographic axis of the alpha phase in the uranium body being extruded is rotated in a direction transverse to the direction of extrusion if the uranium is being extruded in the alpha phase. Inasmuch as the LTE of the b axis of the alpha phase of uranium is negative, the net LTE of the polycrystalline uranium should be lowered in a direction transverse to the direction of extrusion.

However, efforts to provide an extruded uranium-niobium article with desired mechanical properties as described above while manipulating the b axis for providing a decrease in the LTE by using known alpha-phase extrusion practices proved unfruitful. For example, using a uranium-niobium billet preheat temperature of 590° C. was expected to assure that a billet temperature within the alpha-phase temperature region would be provided during the extrusion operation. However, while the extrusion in the alpha phase was successful, some central bursting defects occurred within the extruded alloy article so as to destroy the soundness of the alloy, thereby rendering it useless. To obviate the central bursting defects, a billet preheat temperature of 630° C. was utilized, but this preheat temperature caused the temperature of the billet to increase above the alpha-phase temperature regions (663° C.) during the extrusion and, in effect, destroyed the desirable alpha-phase crystallographic texture without decreasing the LTE to desired levels.

SUMMARY OF THE INVENTION

Inasmuch as a preheat temperature for the billet of about 630° C. was necessary for extruding the alloy in the alpha phase without encountering the central bursting defects in the extruded alloy article, the extrusion process had to be significantly varied from that previously utilized. To achieve this extrusion in such a manner as to benefit from the orientation of the negative b axis so as to minimize the LTE in the direction transverse to the extrusion, it was found that the billet, preheated to 630° C., had to be extruded at an area-based extrusion ratio of at least 8.4:1 or the central bursting defects would be produced in the extruded alloy. During this extrusion, the ram in the extrusion press could have a speed of no greater than 6.8 mm/sec. The die angle through which the extrusion is provided is not critical to the practice of the invention since successful extrusions can be performed at included angles of 60° to 120°. During extrusion, this critical extrusion ratio and ram speed heated the alloy into the alpha plus gamma sub one $(\alpha+\gamma)$ phase region, which exists between 647° C. and 663° C., but not into the beta or gamma uranium phase regions which destroyed the desired texture. By employing the critical extrusion ratio and ram speed, extrusion-formed articles could be prepared that possessed the desired alpha-phase crystallographic texture while providing the alloy an LTE in the transverse direction in the range of 0.88% to 0.98% over a temperature range of 22° C. to 600° C. The extruded uranium alloy article possessed a yield strength of at least 400 MPa, and a compressive yield strength of at least 675 MPa at 0.2% offset, high ductility provided by at least a 25% elongation in 25.4 mm, and an ultimate tensile strength of at least 1,050 MPa. Generally, the method for forming the aforementioned uranium 2.4 wt.% niobium articles in accordance with the principle objective of the present invention comprises the steps of heating a billet of the uranium-niobium alloy to a temperature in the alpha-phase region adequate to effect the extrusion of the billet at a temperature between 647° C. and 663° C., extruding the heated billet into the article form through a die with an extrusion ratio of least 8.4:1 with a ram speed of less than 6.8 mm/sec., quenching the article with water as it exits from the die and thereafter heating the article at a temperature of at least about 580° C. for a duration sufficient to stabilize the alpha-phase crystallographic texture of the uranium in the article without affecting the texture of the alloy.

Other and further objects of the invention will be obvious upon an understanding of the illustrative embodiments about to be described or will be indicated in the appended claims, and various advantages not referred to herein will occur to one skilled in the art upon employment of the invention in practice.

DETAILED DESCRIPTION OF THE INVENTION

The invention is directed to a fabrication of an extruded article of uranium-2.4 wt.% niobium that is characterized by yield strength at 0.2% offset of at least 400 MPa, an ultimate tensile strength of at least 1,050 MPa, a compressive yield strength a 0.2% offset of at least 675 MPa, and an elongation of at least 25% in 25.4 mm, and a linear thermal expansion of less than about 0.98% in the direction transverse to the direction of extrusion over a temperature range of 22° C. to 600° C.

The uranium article possessing the aforementioned mechanical properties as well as the linear thermal expansion in the transverse direction of less than 0.98% is achieved by practicing the method described below. A billet of uranium-2.4 wt.% niobium alloy is heated in an inert atmosphere of argon or the like to a temperature of about 630° C. in the alpha-phase region. The heated billet is extruded into an elongated uranium alloy article at a temperature during the extrusion of between 647° C. and 663° C. through an extrusion die set at an included angle between 60° and 120° with an opening through the die sufficient to effect an area-based extrusion ratio between 8.4:1 to 15.7:1 and with a ram speed in the range of 3.4 mm to 6.8 mm/sec. As the article exits from the die it is quenched with water to room temperature. The quenched article possesses metastable properties which are relieved by heating the article to a temperature in the range between 580° C. to 600° C. for a duration of about 30 minutes to 2 hours.

As pointed out briefly above, the preheat for the billet in the alpha phase to a temperature of about 630° C. is necessary to obviate the occurrence of the central bursting defects in the extruded alloy which detract from mechanical properties of the extruded article. The extrusion parameters described above are critical in that extruding the alloy at an extrusion ratio less than 8.4:1 the central bursting defects would be produced in the extruded alloy. Also, the ram speed of no greater than 6.8 mm/sec. was found to be critical in order to retain the alpha phase during the extrusion even though alloys extruded at ram speed exceeding this critical value would not possess the central bursting defects. The maximum extrusion ratio is about 15.7:1 since extrusion ratios greater than about 15.7:1 do not presently exist for the extrusion of uranium and uranium alloys.

The die angle used for the extrusion can be set at about 60° for the higher extrusion ratios but preferably the die angle of 120° is desired in order to obtain the highest strength ductility, and lowest LTE.

Inasmuch as the quenched extruded article is metastable and would distort during usage, the extruded article is heat treated to stabilize the crystallographic alpha phase in the alloy. This heat treatment does not adversely affect the mechanical or thermal properties desired of the article. The heat treatment is preferably achieved in the alpha-phase range of 580° C. to 600° C. for a period of up to about 2 hours.

In order to provide a more facile understanding of the present invention, an example of a typical extrusion operation is set forth below.

EXAMPLE

Billets of uranium-2.4 wt.% niobium were prepared from depleted uranium and strips of niobium. The billets 162 mm in diameter and 381 mm in length were preheated to 630° C. in an argon atmosphere and held at this temperature for 3.5 hours. The preheated billets were then transferred into a 3850 ton horizontal forward extrusion press. The billet was forced by the press through a lubricated 120° included angle die with a ram press having a rod in a diameter of 46 mm. The ram speed was at a controlled rate of 3.4 mm/sec. The extrusion ratio for this operation was 13.5:1 and the rod as it immerged from the die was quenched with a water spray to room temperature. The quenched article was heat treated at 600° C. for 2 hours to stabilize the crystalline structure of the uranium in the article. The average mechanical properties for the extruded rod indicated a tensile strength 1143 MPa, a yield strength of 0.2% offset at 562 MPa, an elongation in 25.4 mm of 29.6%, a reduction in area of 46.1%, and a compressive yield strength at 0.2% offset of 892 MPa. The LTE of the extruded rod on the first cooling from 600° to 22° C. was 0.91±0.005%.

It will be seen that the present invention provides a novel uranium article achieved by employing critical extrusion parameters which provide the article with an LTE less than previously attainable and without detracting from the mechanical properties of the alloy.

What is claimed is:

1. An extruded article of uranium-2.4 wt.% niobium characterized by a yield strength at 0.2% offset of at least 400 MPa, an ultimate tensile strength of at least 1050 MPa, a compressive yield strength at 0.2% offset of at least 675 MPa, an elongation in 25 mm of at least 25% and a linear thermal expansion of less than 0.98% in a direction transverse to the extrusion over a temperature range of 22° C. to 600° C.

2. An extruded article of uranium-2.4 wt.% niobium as claimed in claim 1 wherein the linear thermal expansion is in the range of 0.88% to 0.98%.

3. A method for extrusion-forming a uranium alloy article of uranium-2.4 wt.% niobium that is characterized by a linear thermal expansion of less than 0.98% in a direction transverse to the direction of extrusion over a temperature range of 22° C. to 600° C., a tensile yield strength at 0.2% offset of at least 400 MPa, a tensile strength of at least 1050 MPa, a compressive yield strength at 0.2% offset of at least 675 MPa, and an elongation of at least 25% in 25.4 mm comprising the steps of:

heating a billet of the uranium-niobium alloy to a temperature adequate to effect the extrusion of the billet at a temperature between 647° C. and 663° C.;

extruding the heated billet into the article through an extrusion die with an area-based extrusion ratio of at least 8.4:1 with a ram speed no greater than 6.8 mm/sec.;

quenching the article to room temperature with water as it exits from the die, and thereafter heating the quenched article to a temperature of at least about 580° C. for a duration sufficient to stabilize the alpha phase crystalline structure of the uranium in the article.

4. The method for extrusion-forming a uranium alloy article as claimed in claim 3, wherein the billet of the uranium-niobium alloy is heated to a temperture of about 630° C. in an argon atmosphere.

5. The method for extrusion-forming a uranium alloy article as claimed in claim 3, wherein the extrusion ratio is in a range of 8.4 to 15.7:1, and the ram speed is in the range of 3.4 to 6.8 mm/sec.

6. The method for extrusion-forming a uranium alloy article as claimed in claim 5, wherein the heating of the quenched article is at a temperature in the range of about 580° C. to 600° C. for a duration of about 0.5 to 2 hours.

* * * * *